US005678247A

United States Patent [19]

Vickers

[11] Patent Number: 5,678,247

[45] Date of Patent: Oct. 21, 1997

[54] ODOR-ABSORBING CLOTHING ARTICLE

[75] Inventor: Thomas Wayne Vickers, Circleville, Ohio

[73] Assignee: Columbus Industries Inc, Ashville, Ohio

[21] Appl. No.: 625,818

[22] Filed: Apr. 1, 1996

[51] Int. Cl.[6] ..... A41D 13/00

[52] U.S. Cl. ..... 2/69; 2/79; 2/243.1

[58] Field of Search ..... 2/69, 79, 80, 243.1, 2/272, 21; 156/277; 428/196

[56] References Cited

U.S. PATENT DOCUMENTS 5,383,236 1/1995 Sesselman ..... 2/69

*Primary Examiner*—Gloria Hale

*Attorney, Agent, or Firm*—Francis T. Kremblas, Jr.

[57] ABSTRACT

Odor-absorbing articles of clothing particularly useful for hunting big game animals wherein the clothing incorporates an intermediate odor-absorbing layer or sheet of material comprising non-woven synthetic fibers impregnated with activated carbon powdered particles. The relatively low cost odor-absorbing sheet possesses a flexible, readily pliant characteristic which permits its incorporation into an article of hunting clothing to preserve the required comfort to the wearer. The odor-absorbing sheet includes a binder which upon drying, adheres the carbon particles to the synthetic fibers without causing the sheet to become stiff and unpliant. The preferred activated carbon loading is about 100 to 200 weight percent of the weight of the non-woven sheet material.

5 Claims, 1 Drawing Sheet

ODOR-ABSORBING CLOTHING ARTICLE

TECHNICAL FIELD

The present invention relates generally to odor absorbing articles of clothing and specifically to articles of such clothing having an improved odor barrier useful for hunters or other persons engaged in activity wherein it is desirable to closely approach a wild animal without the animal's detection of human scent emanating from the person.

BACKGROUND ART

It is well-known that wild game animals have a very keen sense of smell capable of detecting and distinguishing odors deemed unnatural or threatening. Human odor is particularly one source of alerting such game to the presence of humans. Prior attempts to overcome this problem, primarily directed to hunting or similar activities, include attempts to use masking scents to try to cover the scent emanating from humans.

Another solution is to wear odor absorbing clothing, such as disclosed in U.S. Pat. No. 5,383,236 issued on Jan. 24, 1995, wherein the clothing worn by the person includes a form of an odor adsorbent layer to adsorb the scent emanating from the wearer such that the human scent is not detectable to the wild game being approached or approaching the hunter. A currently marketed suit of such special clothing allegedly made in accordance with the above-referred to patent incorporates a thin fabric material having a single layer of discrete particles of activated charcoal adhesively bound in spaced relationship to one another over the surface of the fabric by a silk screening process such as disclosed in U.S. Pat. No. 4,510,193 issued on Apr. 9, 1985.

Other examples of suits or articles of clothing which included an odor absorbing layer are found in U.S. Pat. Nos. 3,783,085 and 4,901,370 which disclose suits worn to protect the wearer from toxic gases in a surrounding environment. It would be most desirable that odor absorbing clothing articles suitable for hunting take the same form as conventional hunting clothing in the nature of coats, vests pants, overalls and the like.

These prior art attempts have yet to solve the problem of providing articles of clothing in the form of conventional hunting coats, pants, overalls or the like having an odor adsorbing layer disposed between an inner and outer lining which provides the desired degree of durability, protection from the environment, pliability and light weight with highly improved odor adsorbing qualities at reasonable cost.

BRIEF DISCLOSURE OF INVENTION

The present invention relates to articles of clothing particularly suitable for hunters and the like which incorporates a layer of material impregnated with activated carbon to adsorb human scent emanating from the wearer of such clothing.

The odor absorbing layer comprises a non-woven sheet of synthetic material impregnated with small particles of activated carbon which acts to adsorb human odors emanating from the wearer. This odor adsorbing layer is highly flexible or pliant and relatively light weight so as to be capable of being incorporated between a conventional outer and inner layers of materials used in making hunting coats, pants, overalls or lightweight suits suitable for use in various climates.

The odor adsorbing layer made in accordance with the present invention may be sewn, stitched or adhesively bound to one or both of the other layers to be effectively incorporated into the article of clothing.

Preferably, the odor adsorbent layer comprises a non-woven sheet of synthetic fibers forming a sheet having a thickness of about at least one eighth to one quarter of an inch and possesses a very pliant and relatively light weight such that the clothing articles are comfortable to wear and do not cause any undo noise when the hunter moves or walks which may likely alert game animals.

Further, and particularly important, the adsorbent sheet of material is impregnated with an amount of powdered activated charcoal particles in the range of about 50 to 200 percent by weight of the non-woven sheet material to provide an effective barrier preventing the escape of human odors emanating from the wearer.

DETAILED DESCRIPTION

The present invention relates to an improved article of clothing adapted for hunters and the like and particularly to such articles of clothing which have an improved layer of odor adsorbing material interdisposed between an outer layer or shell and an inner layer forming a lining. The improved layer of odor adsorbing material comprises a sheet of non-woven synthetic fibers impregnated with powdered particles of activated carbon.

As referred to earlier herein, clothing articles or suits having odor adsorbing qualities have been priorly made, however, the odor adsorbing layer of activated carbon has taken different forms which suffer certain deficiencies as regards to being used in otherwise conventional articles of hunting clothing, such as coats, pants, overalls and the like.

In order to be desirably employed in the manufacture of such articles of hunting clothing, the clothing must retain the characteristics of pliability or flexibility, relatively low weight, outer protection from brush, briars and the like, and reasonably low cost. Further, the odor-removal capacity must be relatively high in order to accomplish the object of adsorbing human scent to avoid detection of the wearer by the wild game being hunted.

The only odor-removal clothing designed specifically for hunters presently in the market is a full suit comprising two relatively thin layers of material having an intermediate layer provided with discrete particles of charcoal adhered to the surface in a spaced relationship. The cost of this apparel is relatively high and is not a suitable substitute for the conventional hunting coat, pants or the like typically worn by the hunter. While it is suggested that it may be worn under such clothes, this requires the purchase of completely separate outfits at a much greater expense.

Prior clothing articles utilized for protective purposes from toxic chemicals in the surrounding environment employ other means for supplying a layer of adsorbent particles between layers of the clothing and involve expensive processes or materials, including sheets of foam or the like which are economically impractical for application to hunting clothing and are relatively bulky and impractical for use in a hunting situation. While some references; such as U.S. Pat. No. 5,382,236 generally refer to materials impregnated with activated carbon as an option, the only materials of this kind available were the very stiff, inflexible sheet layers used in home and commercial filter applications which are described later herein.

Figure 1:
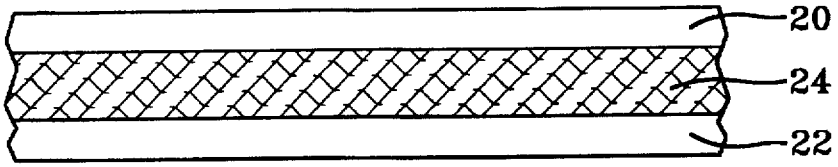
FIG. 1 is a diagrammatic view representing a three layer construction of the material used for an article of hunting clothing constructed in accordance with the present invention.

In accordance with the present invention, a suitable laminate of sheets of material for articles of hunting clothing is shown in FIG. 1 and includes an outer layer or shell 20 of conventional woven or non-woven fabric such as cotton, synthetic fibers, wool, polyester or the like typically employed in present hunting clothing. The inner layer or lining 22 may be any conventional lighter fabric layer which merely provides user comfort and a protective cover shielding the wearer's skin from the intermediate odor-adsorbent sheet layer.

The odor adsorbent layer 24 comprises a sheet of non-woven synthetic fibers impregnated with powdered activated charcoal using a binder which provide a satisfactory degree of pliability to the resulting sheet layer and yet aptly bonds the carbon particles within the sheet of fibers.

The odor adsorbing layer preferably includes an activated carbon loading of between about 50 to 200 percent by weight of activated charcoal and binder on the basis of the weight of the original sheet of non-woven synthetic fibers. More preferred is an activated carbon binder loading of between 100 to 150 percent to provide a higher degree of human odor adsorbing capacity.

The layer of odor absorbing material should be at least ⅛ inches thick to provide sufficient activated carbon and very importantly provide a higher residence time of the human scent within the odor absorbing layer to achieve greater odor adsorbing efficiency. It is more preferred to employ a thickness of about ¼ inches for the odor absorbing sheet layer.

Odor absorbing sheets of activated carbon impregnated non-woven synthetic fibers have long been used in commercial and residential filters to filter various odors. However, the construction of such filter media make them unsuitable for use in clothing articles as such filter media are very stiff and non-pliable so as to be inappropriate for clothing applications. While relatively much less expensive than other forms of odor-absorbing material constructions such as disclosed in the prior art, this lack of suitable pliability or softness is well-known and accounts for the use of other means to incorporate into a clothing article suitable for use in active wear clothing, such as articles of hunting clothes.

However, in accordance with the present invention, a sheet of non-woven synthetic fibers impregnated with a high loading of activated carbon which has the necessary flexibility and softness or pliability to perform very well as an intermediate, relatively light weight layer of odor adsorbing material has been developed. This relatively low cost material further provides very excellent odor removal qualities compared to the prior art forms which together with its degree of flexibility and softness has enabled its incorporation into otherwise conventional articles of hunting type clothing to provide an improved and very effective odor-removing clothing article.

Figure 2:
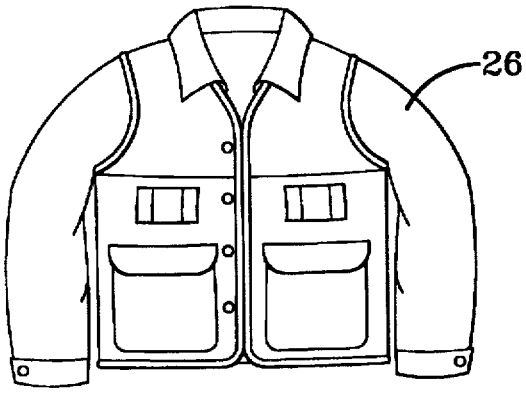
FIG. 2 is a front view of a hunting coat of conventional style representing one form of clothing article constructed in accordance with the present invention.
Figure 3:
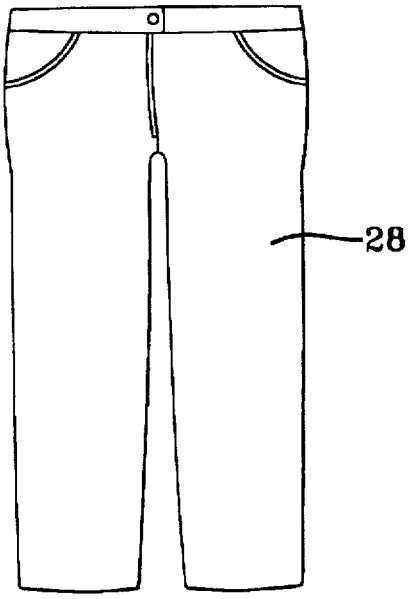
FIG. 3 is a front view of a pair of hunting pants of conventional style constructed in accordance with the present invention.
Figure 4:
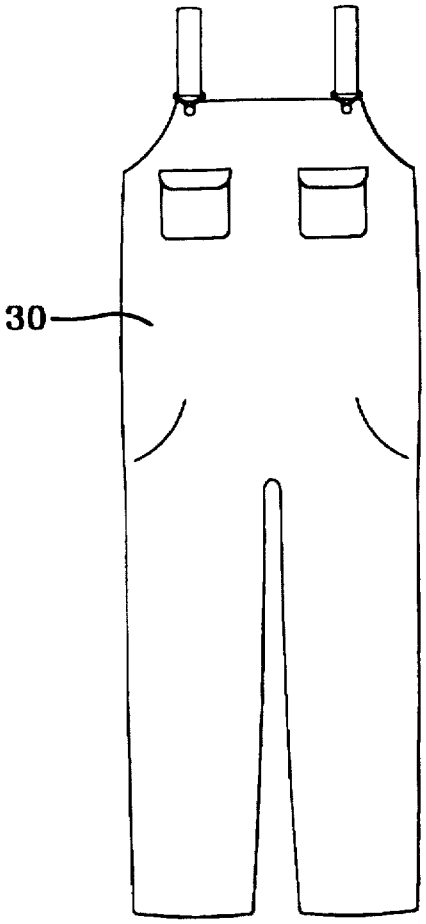
FIG. 4 is a front view of a pair of hunting overalls of conventional style constructed in accordance with the present invention.

Hunting clothing in conventional style such as seen in FIGS. 2–4 include a coat 26, pants 28, or overalls 30. The clothing article must not only be essentially as comfortable to the wearer as the conventional form without the odor-absorbing layer, but very importantly, must be essentially as quiet during normal active movements of the wearer. For this reason, the outer layer is preferably a soft material which will make little noise when the hunter moves about in the hunting environment. The typical activated carbon impregnated non-woven synthetic sheet material used in conventional industrial and residential odor removal air filters are impractical because of their stiffness or lack of pliability which would make clothing articles uncomfortable to wear and/or make too much noise during routine movement of the wearer.

The stiffness of conventional prior art carbon impregnated, non-woven synthetic fiber filter material is primarily due to the nature of the adhesive binders used to adhere the powdered carbon particles to the fibers throughout the depth of the non-woven fiber pad or sheet.

These adhesive binders referred to as "hard" in the art, render the non-woven synthetic fiber sheet relatively stiff or inflexible upon being dried, yet are preferred due to their excellent binding characteristics which hold the activated carbon powder particles in position on the fibers and provide added strength to the non-woven sheet forming the filter pad.

Since the inflexibility of this form of sheet rendered it unusable as a practical matter in hunting clothing, a new type of odor-absorbing sheet layer was required. Such a sheet layer was developed by incorporating what is referred to as a soft binder into the non-woven sheet which was found to sufficiently hold the activated carbon powder particles on the fibers, but not render the non-woven sheet material stiff and unyielding upon being cured.

Binders which have this softer cured state and yet sufficient binding strength include polymer resin emulsions, such as Rhoplex B-15 sold by Rohm and Haas Company. Such resin binders can be classified by reference to their glass transition temperature which is the temperature at which the polymer resin changes from a plastic mass into a rigid, hard structure. The higher the glass transition temperature of these polymer resins, the harder or stiffer "feel" they tend to exhibit upon being dried and cured. While there is no exact glass transition temperature which delineates the harder from the softer "feel" resin binders, as one approaches resins having a glass transition temperature of approximately 50 to 60 degrees F. or greater, they would begin to be classified as hard.

The terms hard and soft as applied to these types of resin binders is conventionally referred to as "hard hand" or "soft hand" which are relative terms to the feel imparted to the material incorporating these resins as binders.

The "hard hand" polymer resins therefore tend to form a relatively brittle structure upon being dried, whereas the "soft hand" resins tend to be softer and retain a degree of tackiness.

Rhoplex B-15 has a glass transition temperature of 23 F. degrees. Rhomplex AR-74 another resin binder available from Rohm and Haas Company, has a glass transition temperature of 104 degrees F. and has been successfully used in the prior home and commercial activated carbon filter structure referred to earlier herein. However, this latter binder renders the non-woven sheet stiff and is classified as a "hard" binder.

It was also discovered that the carbon loading applied to the non-woven sheet layer affects the stiffness or flexibility of the sheet. While a heavy loading may be desirable to create a greater capacity for absorbing odors, as one approaches an add-on of 200 percent by weight of binder and carbon based upon the weight of the non-woven sheet, the flexibility of the sheet approaches a level which becomes undesirable for hunting clothing applications. It has been found that add-on values of activated carbon in the range of about 100 to 150 weight percent of the weight of the synthetic fiber sheet are greatly preferred to provide highly adequate adsorption capacity and yet maintain very good flexibility to the article of clothing.

Therefore, it has been found that a very desirable, non-woven sheet layer impregnated with activated carbon can be employed as an intermediate layer in hunting clothing which will adsorb human odors emanating from the wearer, yet will not render the clothing uncomfortable or too stiff for practical use, while maintaining essentially the quiet nature of an otherwise identical hunting garment which is not provided with the scent-adsorbing layer.

The important parameters of the scent absorbing non-woven synthetic fiber layer described herein include a thickness of between about ⅛ to ¼ inches, a carbon add-on of about 100 to 150 percent by weight, and use of a soft binder material such as described which permits the adsorbent layer to retain a degree of flexibility suitable to retain the normal comfort and ease of movement found in typical hunting clothing without the scent adsorbing layer.

The binder used should be non-oxidizable over time in typical ambient conditions encountered in hunting and must retain its soft, flexible state after being dried and cured. Resin type binders having a glass transition temperatures less than about 50 degrees F. are preferred and would be expected to remain in a relatively soft, tacky state upon drying.

The synthetic sheet impregnated with activated carbon powder particles, using suitable soft binders as described herein will have a tendency to become more dense and lose its thickness temporarily in the area where significant pressure is applied to the sheet. However, the characteristic referred to as tackiness herein, is such that the sheet will rebound to its original density and thickness in a relatively short time after the applied pressure is removed. If the dried binder will permanently cause the non-woven fibers of the sheet to be bound together upon the application of pressure, the binder is unsuitable for this application described herein.

I claim:

1. An article of outdoor clothing comprising, in combination, a) an outer layer;

b) an inner lining;

c) an odor removal layer disposed between said outer layer and inner lining and including a non-woven, flexible sheet of synthetic fibers impregnated with activated charcoal particles, said charcoal particles being bound to said synthetic fibers by adhesive binder, said binder comprising a polymer resin binder having a glass transition temperature of less than about 60 degrees F.

2. The article defined in claim 1 wherein the loading of activated carbon and binder of said odor-removal layer is in the range of about 100 to 200 weight percent of the weight of the synthetic fiber sheet.

3. The article defined claim 1 wherein said clothing is in the form of a coat covering the arms and torso area of the wearer.

4. The article defined in claim 1 wherein the clothing is in the form of a pair of pants covering the legs and lower torso area of the wearer.

5. The article defined in claim 1 wherein said clothing is in the form of a pair of overalls covering the legs and torso area of the wearer.

* * * * *